United States Patent [19]

Murakami et al.

[11] 4,075,825

[45] Feb. 28, 1978

[54] ELECTRONIC TIMEPIECE SUBSTRATUM

[75] Inventors: Tomomi Murakami, Yamato; Masaru Yoshida, Murayama; Satoshi Kimura, Tokorozawa; Tetuya Yasuda, Tokyo; Yoshio Iinuma, Kodaira, all of Japan

[73] Assignee: Citizen Watch Co., Ltd., Tokyo, Japan

[21] Appl. No.: 592,099

[22] Filed: Jun. 30, 1975

[30] Foreign Application Priority Data

| | | |
|---|---|---|
| Jun. 28, 1974 | Japan | 49-073420 |
| Aug. 27, 1974 | Japan | 49-098153 |
| Jul. 22, 1974 | Japan | 49-087116[U] |

[51] Int. Cl.[2] ..... G04C 3/00; G04B 37/00

[52] U.S. Cl. ..... 58/23 R; 58/52 R; 58/55; 58/88 R

[58] Field of Search ..... 58/4 A, 23 R, 23 BA, 58/50 R, 53–55, 88 R; 174/52 R, 52 FP; 350/160 LC; 340/336

[56] References Cited

U.S. PATENT DOCUMENTS

| | | | |
|---|---|---|---|
| 3,672,155 | 6/1972 | Bergey et al. | 58/50 R |
| 3,778,999 | 12/1973 | Vuffray | 58/23 R |
| 3,784,725 | 1/1974 | Perkins | 174/52 R |
| 3,863,436 | 2/1975 | Schwarzchild et al. | 174/52 R |
| 3,910,029 | 10/1975 | Yamazaki | 58/50 R |

*Primary Examiner*—E. S. Jackmon
*Attorney, Agent, or Firm*—Koda and Androlia

[57] ABSTRACT

A watch body for an electronic watch containing an integrated circuit chip and a printed circuit board is disclosed. The watch body comprises an upper case and a bottom cover which are selectively interconnected one with the other. A lead package frame is sandwiched between the upper case and the bottom cover and contains a plurality of electrical leads disposed thereon and electrically coupled to the integrated circuit chip. The lead frame has first and second sides with the first side having a first cavity with the integrated circuit chip matingly engaged therein. The plurality of leads are disposed on the first side of the lead frame so as to surround this first cavity down the circuit chip. The second side of the lead frame has a second cavity with the printed circuit board disposed therein. By the use of the watch body of the instant invention, a significantly smaller number of components, a simpler manufacturing process is achieved.

21 Claims, 7 Drawing Figures

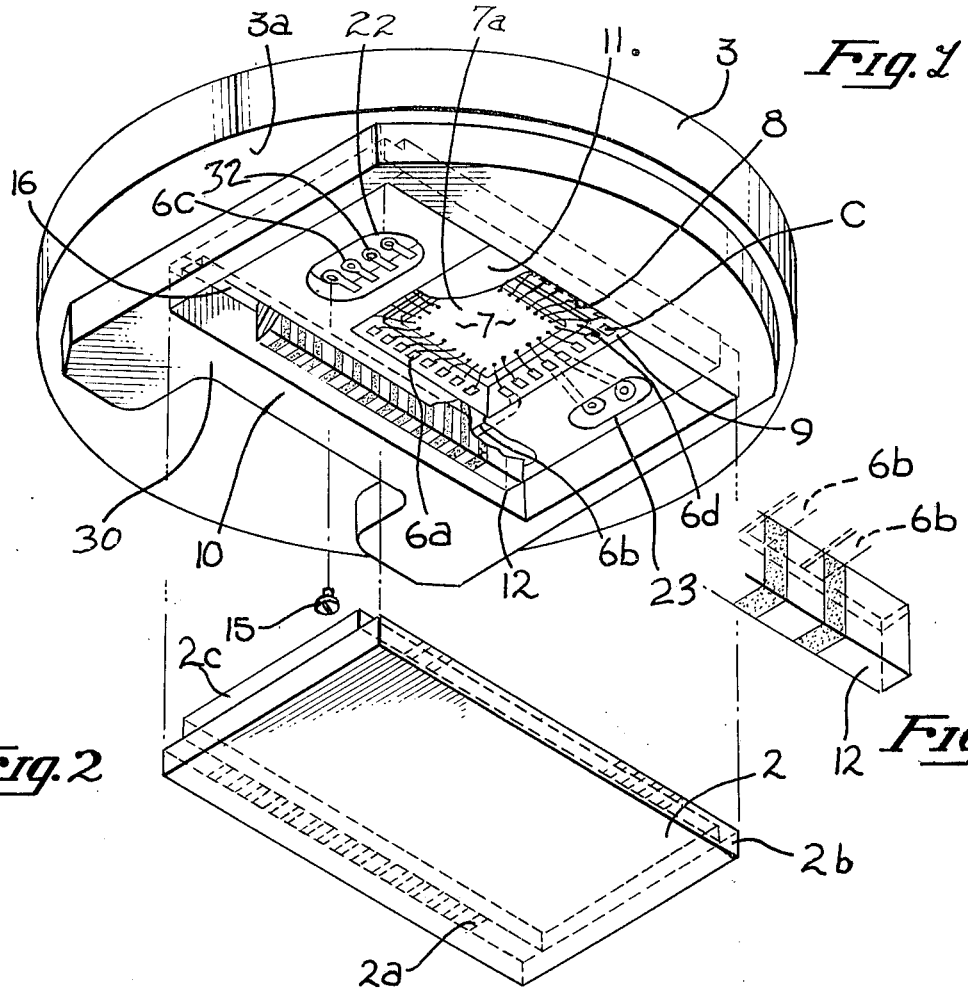
Fig. 1
Fig. 2
Fig. 7
Fig. 3
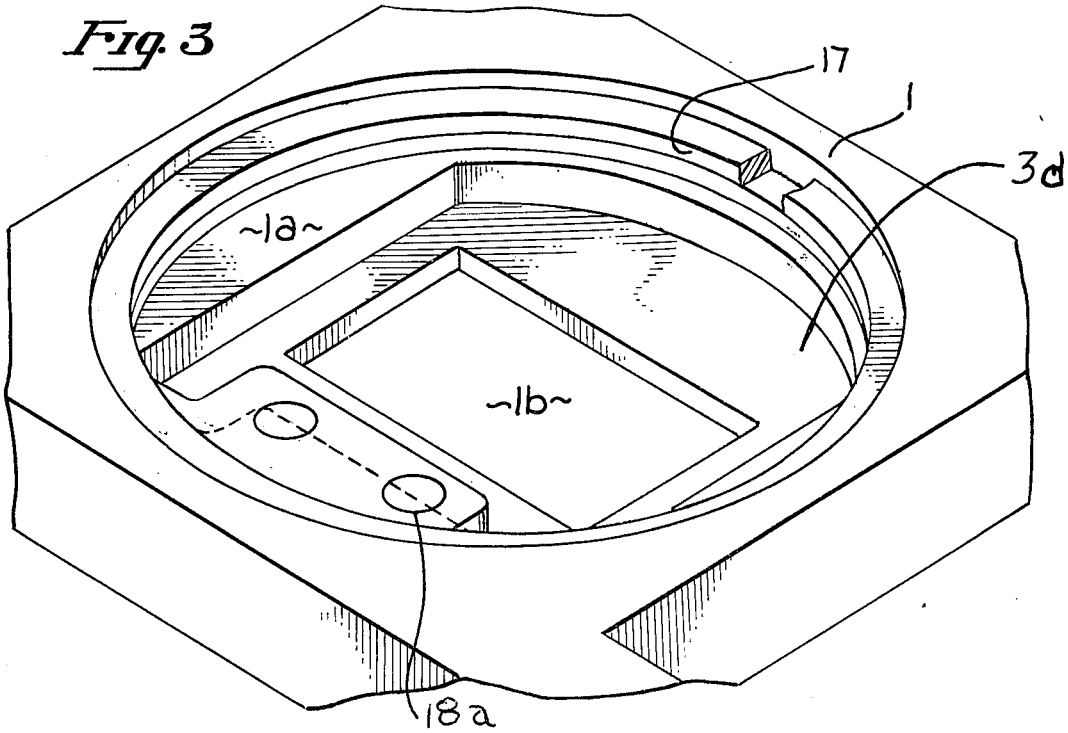

ELECTRONIC TIMEPIECE SUBSTRATUM

BACKGROUND OF THE INVENTION

1. Field of the Invention

This invention relates to a structure for a watch body, and more particularly, to a structure for an electronic watch having a liquid crystal display cell and an integrated circuit chip.

2. Description of the Prior Art

The prior art teaches that mechanical-electronic parts of an electronic watch having a liquid crystal display cell and an integrated circuit to drive the cell may be disposed in a holder which supports and fixes the position of the cell. Such prior art watches generally contain a package of the integrated circuit disposed in a watch body which also holds various other components. These components must be prepared separately and various unifying means such as soldering and the like are used to join the various components together. For example, the liquid crystal cell, the integrated circuit chip and the printed circuit board are usually joined together by solder and wires. Such means of joining various components renders the manufacturing process rather complex and time consuming in terms of the number of different components which make up a typical electronic watch and the difficulty of working with such same components.

The prior art also discloses that a metal lead frame should be disposed in the watch body to hold the integrated circuit chip in order to the position of the electrodes of the liquid crystal cell before establishing the electrical connection. This metal lead frame thus adjusts and settles the electrical leads used to make electrical connection with the liquid crystal cell. This arrangement, however, suffers from the disadvantage of utilizing additional parts which, under the prior art method, are necessary in order to keep the large number of leads in specific arrangement and control so as not to short-circuit with each other. Under such an arrangement, the leads and contacts are susceptible to being contaminated or deformed during the complicated manufacturing process. Finally, the relative position between the electrodes of the cell and each lead of the contact members (the connectors) may slightly shift during manufacturing, and under the prior art process, it is extremely difficult if not impossible to prevent this propensity to shift, or to correct it once it has occured.

SUMMARY OF THE INVENTION

The present invention relates to a watch body for an electronic watch which has an upper case of a generally circular configuration as is well known in the art. The upper case and bottom case cover press fit together. A lead frame is sandwiched between the upper case and the bottom cover and contains a plurality of electrical leads disposed thereon. The lead package is also of a generally circular configuration and is arranged and configured so as to be selectively and matingly engaged in the upper case. The leads disposed on the lead frame are electrically coupled to an integrated circuit chip which is disposed in the lead frame with a predetermined number of the leads coupled to the lead frame.

The lead frame has first and second sides with the first side having a first cavity located in a downward-extending holder member which member is arranged and configured to matingly engage an integrated circuit chip therein. The plurality of leads are also disposed on the first side of the lead frame within the holder so as to completely surround the first cavity containing the circuit chip. The second side of the lead frame has a second cavity disposed therein with a printed circuit board arranged and configured in this second cavity. The lead frame also has selected openings such as holes and the like disposed therethrough adjacent a predetermined number of the leads such that the leads selectively couple with electrically active members on the circuit board and thereby electrically couple the circuit board to the integrated circuit chip. Note, however, that the connection between the circuit board and the chip is characterized by being "solderless" although a soldering-type connection may be used.

A further improvement of the instant invention over the prior art is that a liquid crystal cell is matingly engaged in a third cavity member located atop and adjacent to the first cavity. This configuration permits the liquid crystal cell to be electrically coupled to the leads, and thus to the circuit chip and to the circuit board. Again, the connection between the liquid crystal cell and the leads is characterized by being solderless, although a typical solder-type connection can be used. In a preferred embodiment flexible, interconnector members are disposed in the first cavity such that the liquid crystal cell is electrically coupled to predetermined leads. The flexible interconnector member represents yet further improvement over the prior art.

It is thus an object of the instant invention to provide a watch body which includes an integrated circuit chip, a liquid crystal cell, and a holder to set the position of the liquid crystal cell as a single unit whereby the electrical connection between the components is easily achieved.

Another object of the instant invention is to provide a watch body wherein the manufacturing steps used to assemble the watch are less complex and less expensive and do not require a large number of interconnecting components to couple various elements of the watch together.

It is yet another object of this invention to provide a watch body with a flexible interconnector member which is designed such that it has a relatively simple structure which enables an electrical connection to be made between the cell and the chip without the problems associated with the prior art.

The novel features which are believed to be characteristic of the invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only, and are not intended as a definition of the limits of the invention.

BRIEF DESCRIPTION OF THE DRAWINGS

FIG. 1 shows an upward perspective view of an embodiment of the lead package frame of this invention.

FIG. 2 shows a perspective view of a liquid crystal cell to be engaged in the lead package frame of FIG. 1.

FIG. 3 shows a downward perspective view of an upper watch case in which the lead frame is contained.

FIG. 7 shows a perspective view of the flexible interconnectors for the liquid crystal cell.

DETAILED DESCRIPTION OF THE PREFERRED EMBODIMENT

Figure 4:
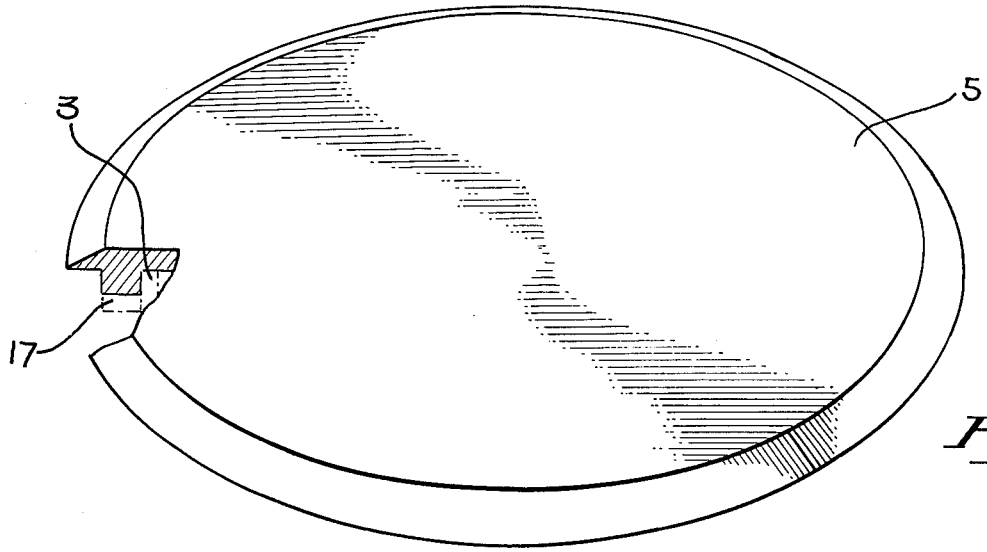
FIG. 4 shows a downward perspective view of the bottom cover which is to be joined to the upper watch case of FIG. 3.

Referring first to FIG. 1, a lead package frame 3 is clearly shown. Lead package frame 3 is arranged and configured so as to be selectively engaged and securely positioned in an associated upper watch case 1 (FIG. 3) so as to be sandwiched between the upper case 1 and the back cover 5 (FIG. 4). The lead package frame, or lead frame as hereinafter sometimes referred to, has a generally circular, tube-like configuration with a first side 3*a* and a second side 3*b* (see FIG. 6). The first side 3*a* has a downward-extending projection or holder member 10 disposed thereon which projection has a generally arcuous top section and joined to two substantially parallel spaced apart leg members. It has been found that this type of configuration can be matingly engaged in an equivalently shaped cavity 3*c* disposed adjacent the bottom of a watch case 1 as is shown in FIG. 3. Moreover, because the downward-extending projection member or holder 10 is formed with a unitary construction on the lead frame 3, such configuration is relatively simple and inexpensive to manufacture and simplifies assembly. For example, the holder 10 and the associated frame 3 can be made of a unitary one-piece molded plastic.

The first side 3*a*, and more specifically, the holder 10, has a first cavity 7*a* of a generally rectangular configuration disposed toward the center thereof. Cavity 7*a* is arranged and configured such that an associated integrated circuit chip 7 may be positioned therein such that it matingly engages the walls of the cavity 7*a* and is held in position. A plurality of leads 6*a*, 6*b*, 6*c*, and 6*d* are also disposed on the first side 3*a*, and more specifically, adjacent the cavity 7*a* holding the integrated circuit chip 7. Such leads are arranged and configured so as to completely surround the integrated circuit chip and are electrically coupled to the integrated circuit chip 7 by means of wires 8 as is well known in the art. Other configurations of the leads and the location of the cavity are also within the scope of this invention.

Holder 10 also has two generally rectangular slots 16 disposed on opposed sides of the cavity 7 in a generally parallel, spaced apart configuration. Slots 16 selectively engage interconnector members 12 and position members 12 in a predetermined location. Interconnector member 12 are thus arranged and configured and matingly engage output leads 6*b*, as is shown in FIG. 7. Also shown in FIGS. 1 and 7 is the fact that the interconnector members 12 are made of alternately downward extending sections of conductive sections and nonconductive sections. In the presently preferred embodiment, the nonconductive sections are made of rubber. Thus, the conductive sections are matingly engaged with the output leads 6*b*.

The interconnectors 12 are also arranged and configured to matingly engage with the liquid crystal cell 2 and more specifically with electrodes 2*a* disposed thereon as is shown in FIG. 2. Liquid crystal cell 2 is arranged and configured so as to be yieldably engaged in the holder 10, more specifically in cavity 30, the third cavity in the lead frame 3. The liquid crystal cell 2 has a generally rectangular configuration with a generally rectangular member 2*b* disposed atop a base member 2*c*. Such generally rectangular configurations of the entire liquid crystal cell 2 fit into corresponding cavity 30 which cavity is also on the first side 3*a* of the package 3 atop and adjacent to the cavity 7*a* holding the integrated circuit chip 7. When in position, liquid crystal cell 2 is electrically coupled to the interconnector members 12 and thus an electrical path is formed between electrodes 2*a* through the conductive sections of the interconnector 12 to a predetermined number of the leads 6, and more specifically, to output leads 6*b*.

As discussed hereinabove, one problem with the prior art assemblies was that the leads used to connect the integrated circuit chip with other elements of the watch require very complex positioning and attaching members. In the instant invention, this problem is substantially reduced and eliminated by the use of an insert molding. This problem is further reduced because the integrated circuit chip 11 disposed in cavity 7*a* has a plastic coating 11 disposed thereover. Thus, the chip 7, the wires 8, and the leads 6*a*–6*d* are covered with the plastic coating 11 to protect those components against any mechanical damage, shortcircuiting with other components as well as movement of the leads. Coating 11 may be any of the well-known plastic resins used in the art such as, for example, epoxy resin and the like. One can see in FIG. 1 that leads 6*a*–6*d* are disposed in and extend through the plastic film 11, the second end sections of which are electrically coupled to wires 8.

Figure 5:
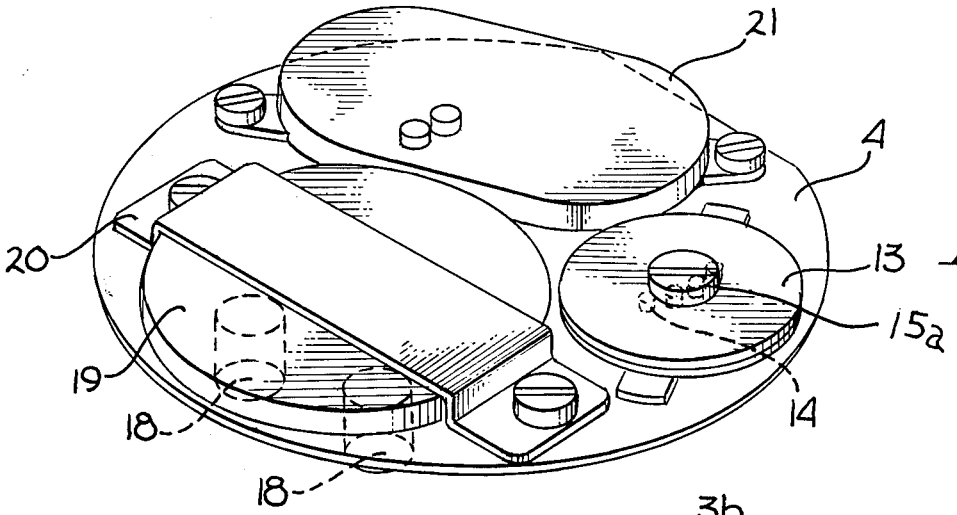
FIG. 5 shows a perspective view of a print circuit board which contains the electronic components.
Figure 6:
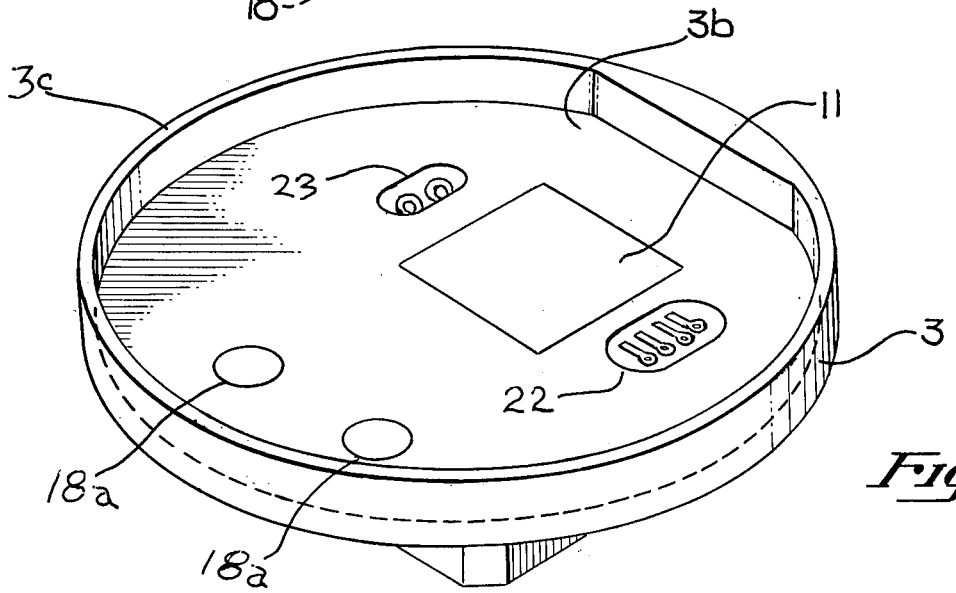
FIG. 6 shows a downward perspective view of the lead frame of FIG. 1.

Referring now to FIG. 6, the second side 3*b* of the lead frame 3 is shown. This second side has a second cavity 3*d* disposed therein formed by the rim member 3*c*. This cavity is arranged and configured to selectively engage an associated printed circuit board 4 as is shown in FIG. 5. All the specific components of the circuit board 4 will not be discussed in detail herein as such circuit boards are well known in the art and any typical watch circuit is within the scope of this invention.

A typical circuit board is shown in FIG. 5 and is provided with a crystal oscillator 21 and a trimmer capacitor 13 screwed or otherwise attached thereto. A battery 19 is also attached to the circuit board 4 by a battery fastener 20. Beneath battery fastener 20 there are provided switch pins 18 which are disposed through an associated opening or hole 18*b* disposed in the lead frame 3 as shown in FIG. 6 and are engaged by holes 18*a* in the case (FIG. 3). Switch pins 18 are thus used to couple the circuit board 4, the lead frame 3 and upper watch case 1 together so as to hold these components in alignment. Switch pins 18 can also be used as electric contacts for other elements of the watch. Thus, the printed circuit board 4 has independent outer parts such as capacitors 13 distributed thereof, and, in addition, has a tube or a plurality of tube-like electrical contacts 14 soldered onto the board 4 to connect with the input leads 6*c* of the chip 7. Contacts 14 may be connected to the output leads 6*c* by means of upward-extending screw member 15 shown in FIG. 1 and are arranged and configured such that they proceed through opening 22 on lead frame 3 and make contact with a predetermined number of input leads 6*c*.

A ledge 9 is formed adjacent the integrated circuit chip cavity 7*a* which provides a fence to control the extent to which the plastic film 11 flows across the top of chip 7 and positions the wires 8 therein. The leads 6*d* extend from ledge 9. Accordingly, the lead frame 3 includes the ledge 9 to control the plastic flow, the holder 10 to matingly engage the liquid crystal cell 2, and the leads 6a–6d disposed therein with a predetermined number of the leads are electrically coupled to the interconnector 12. In the presently preferred embodiment, the interconnector 12 is a relatively long rod with a rectangular cross-sectional shape and which facilitates the connection between the output lead 6b on the chip 7 and the electrodes 2a of the cell 2. The interconnector 12 thus may be composed of laminated rubber with conductive and nonconductive rubber sections. The conductive sections have the same width as the electrodes 2a of the cell 2 as shown in FIG. 7.

Referring to FIG. 3, upper watch case 1 has a recess 1a into which a downward-extending member or holder 10 fits. The back cover 5 is firmly fixed and held in position by a waterproof rubber ring 17. The frame 3 is fixed inside the watch case 1 when the back cover 5 (FIG. 4) is pressed into the watch case 1 and thus causes a seal to be formed between the rubber ring 17 which surrounds the periphery of an inside ledge of the upper watch case 1. Numeral 1b represents an opening of the watch case 1 which has a transparent plastic window (not shown) disposed therein such that the time or other associated information can be readily seen. Such configuration of the opening, the transparent plastic material disposed therein, and the like are well known in the art and will not be discussed further.

In assembling the watch of the instant invention, the back cover 5 is firmly fixed into the upper watch case 1 in which the lead frame 3 is contained such that all the mechanical-electrical parts are securely positioned therein. The integrated circuit chip 7 is electrically coupled to the printed circuit board 4 inasmuch as the lead frame 3 has openings 22 and 23 disposed therethrough which openings are arranged and configured so as to expose leads 6c and 6d. The ends 32 of leads 6c and 6d are then coupled to the integrated circuit board 4 by means of screw members 15 and the like. Thus, the leads 6c and 6d matingly engage and are held in position against the contacts 14 disposed on the board 4. A substantially equivalent system, i.e., contacts and/or screws, can be used to couple the output leads 6b.

The integrated circuit chip 7 in conjunction with the circuit board 4 drives the liquid crystal display system and counts the time. Leads 6a are connected to the integrated circuit chip 7 by wire bonding in order for the chip 7 to transmit the input and output to associated elements liquid crystal cell 2 and circuit board 4. The output leads 6b are arranged and configured so as to transmit the input signal of the liquid crystal cell 2 in order to drive the display system (not shown). The lead 6c works as a contact between the chip 7 and the other electric circuits; lead 6c being provided with an opening for a screw to make such contact.

Each of the leads 6a–6d may thus be manufactured in a manner such that the leads 6a are mounted within a plastic matrix as a single pattern and then separated from one another. In another alternative embodiment, the leads are molded altogether on the lead frame 3, and then separated to form each lead. In addition, the leads may be prepared by molding as a part of the lead frame 3 and separated into specific segments by known etching techniques and the like.

Thus, the watch body according to this invention provides such advancement in the art that the number of components is significantly reduced which is directly related to the fact that the holder 10 for the liquid crystal cell 2 and the integrated circuit chip 7 are formed in a single cohesive plastic unit resulting in a simplification of the manufacturing process steps and a reduction in the component parts. Moreover, many of the components are easily interchangeable as the ends of such parts are coupled together by means of a screw. This is to be contrasted with the prior art where such elements are electrically coupled together by means of soldering and the like which did not render them substantially interchangeable. Moreover, the following advancements have been accomplished: (1) leads 6a–6d can be kept in accurate and stable relative position thereinbetween because the holder of the cell may be prepared in the form of a single unit by use of any well-known plastic molding techniques. Moreover, ends 32 have a hole or other means which can be easily coupled to the printed circuit board and to the crystal oscillator; (2) the interconnector 12 and the cell 2 are supported and fixed by means of a cell holder 10 which is a part of the lead frame 3 whereby any appreciative shift in their relative positions is de minimus; and (3) the interconnector 12 and especially the conductive rubber layers can keep a constant position. Moreover, the interconnector 12 may be easily replaced when its useful life is exhausted. The watch of this invention not only reduces the number of components in the manufacturing steps but also improves the shock resistance of a watch movement. Thus it is especially effective when the circuit board is made of any fragile substance as ceramics and the like.

There has been described herein a new and novel watch. However, it is to be understood, that various alternative embodiments using the principles of the present invention may readily be incorporated. For example, one or more interconnector members 12 may be used in various configurations. And other non-conductive materials can be used for the lead frame 3, watch case 1 and bottom cover 5. Thus, while one specific embodiment has been disclosed and described in detail herein, it will be understood by those skilled in the art that various changes in form and detail may be made therein without departing from the spirit and scope of this invention.

We claim:

1. A watch body for an electronic watch comprising:

a. an upper case and a bottom watch cover, said upper case and bottom cover each containing means for selectively interlocking one with the other thereby forming a discrete watch body;

b. a lead package frame sandwiched between said upper case and said bottom cover, said lead frame having first and second sides, said first side having a first cavity disposed therein arranged and configured to receive an integrated circuit chip, and said second side of said lead frame arranged and configured to detachably engage a printed circuit board; and c. a liquid crystal cell disposed in an associated holder member such that said liquid crystal cell is adjacent said first cavity on said lead frame, said holder member extending downward from said lead frame.

2. The watch body according to claim 1 wherein said lead package frame has a generally circular configuration with said first cavity disposed in said holder member.

3. The watch body according to claim 2 wherein said holder member has an arcuous top section joined to two spaced-apart legs.

4. The watch body according to claim 3 wherein the interior of said upper case is arranged and configured to selectively engage said holder member.

5. The watch body according to claim 1 wherein said lead package frame has a downward-extending interconnector member, said interconnector member electrically coupled to a predetermined number of said leads and arranged and configured to matingly engage said liquid crystal cell such that said liquid crystal cell is electrically coupled to a predetermined number of said leads.

6. A watch body for an electronic watch comprising:

a. an upper watch case and a bottom watch cover, said upper case and bottom cover each containing means for selectively interlocking one with the other thereby forming a discrete watch body;

b. a lead package frame sandwiched between said upper case and said bottom cover, said lead frame containing a plurality of electrical leads disposed thereon electrically coupled to an integrated chip, said lead frame having first and second sides, said first side having a first cavity disposed therein arranged and configured to receive said integrated circuit chip, said plurality of leads disposed on said first side of said lead frame so as to surround said first cavity, and said second side of said lead frame having a second cavity arranged and configured to detachably engage a printed circuit board; and c. a liquid crystal cell disposed in said lead frame adjacent said first cavity, said liquid crystal cell electrically coupled to a predetermined number of said leads.

7. The watch body according to claim 6 wherein said liquid crystal cell is disposed in a holder member, said holder member attached to said first side of said lead frame and extending downward therefrom.

8. The watch body according to claim 6 wherein said lead package frame has a generally circular configuration with said first cavity disposed in a downward-extending holder member disposed on said first side of said lead frame, and said liquid crystal cell being retained in said holder member.

9. The watch body according to claim 8 wherein said downward-extending holder member has an arcuous top section joined to two spaced-apart legs.

10. The watch body according to claim 9 wherein the interior of said upper case is arranged and configured to selectively engage said downward-extending holder member.

11. The watch body according to claim 6 wherein said lead package frame has at least one downward-extending interconnector member, each said interconnector member electrically coupled to a predetermined number of said leads and arranged and configured to matingly engage said liquid crystal cell such that said liquid crystal cell is electrically coupled to a predetermined number of said leads.

12. The watch body according to claim 11 wherein two said interconnector members are disposed in said lead frame in a generally parallel, spaced-apart configuration.

13. The watch body according to claim 11 wherein said interconnector member is made of alternating downward-extending sections of conductive sections and nonconductive sections.

14. The watch body according to claim 13 wherein said nonconductive sections are made of rubber.

15. The watch body according to claim 6 wherein said attaching means are screws.

16. The watch body according to claim 15 wherein said screws are disposed through said printed circuit board and thereby couple said board to said lead frame.

17. A watch body for an electronic watch containing an integrated circuit chip and a printed circuit board comprising:

a. an upper watch case and a bottom watch cover, said upper case and said lower cover selectively interconnected;

b. a lead package frame sandwiched between said upper case and said bottom cover, said lead frame containing a plurality of electrical leads disposed thereon electrically coupled to said integrated circuit chip said lead frame having first and second sides, said first side having a first cavity with said integrated circuit chip matingly engaged therein, said plurality of leads disposed on said first side of said lead frame so as to surround said first cavity and said circuit chip, sand second side of said lead frame having a second cavity with said printed circuit board detachably disposed therein, said lead frame having selected openings disposed therethrough adjacent a predetermined number of said leads such that said leads engage said circuit board and electrically couple said circuit board to said integrated circuit chip; and c. a liquid crystal cell disposed in said lead frame adjacent said first cavity, said liquid crystal cell electrically coupled to a predetermined number of said leads.

18. The watch body according to claim 17 wherein said lead package frame has at least one downward-extending interconnector member, each said interconnector member electrically coupled to a predetermined number of said leads and arranged and configured to matingly engage said liquid crystal cell such that said liquid crystal cell is electrically coupled to a predetermined number of said leads.

19. The watch body according to claim 18 wherein two said interconnector members are disposed in said lead frame in a generally parallel, spaced-apart configuration.

20. The watch body according to claim 18 wherein said interconnector member is made of alternating downward-extending sections of conductive sections and nonconductive sections.

21. The watch body according to claim 13 wherein the leads are insert molded to become said lead package frame with plastic.

* * * * *